US010508508B2

(12) United States Patent
Vu et al.

(10) Patent No.: US 10,508,508 B2
(45) Date of Patent: Dec. 17, 2019

(54) QUICK RELEASE DIE BLOCK SYSTEM

(71) Applicant: Nabors Drilling Technologies USA, Inc., Houston, TX (US)

(72) Inventors: Tommy Vu, Houston, TX (US); James Cooper, Spring, TX (US); Faisal Yousef, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 195 days.

(21) Appl. No.: 15/859,614

(22) Filed: Dec. 31, 2017

(65) Prior Publication Data

US 2019/0203547 A1 Jul. 4, 2019

(51) Int. Cl.
*E21B 19/16* (2006.01)

(52) U.S. Cl.
CPC ..... *E21B 19/16* (2013.01); *E21B 19/163* (2013.01)

(58) Field of Classification Search
CPC ..... E21B 19/16; E21B 19/161; E21B 19/163
See application file for complete search history.

(56) References Cited

U.S. PATENT DOCUMENTS

| | | | | |
|---|---|---|---|---|
| 2,962,919 | A * | 12/1960 | Grundmann | E21B 19/10 81/186 |
| 6,253,643 | B1 * | 7/2001 | Buck | E21B 19/161 81/185.1 |
| 8,393,251 | B2 * | 3/2013 | Dagenais | E21B 19/161 81/185.1 |
| 9,085,023 | B2 * | 7/2015 | Danhash | B21D 39/04 |
| 2002/0108748 | A1 * | 8/2002 | Keyes | E21B 19/161 166/77.51 |
| 2015/0144355 | A1 * | 5/2015 | Webb | B25B 5/147 166/379 |

* cited by examiner

*Primary Examiner* — David B. Thomas

(57) ABSTRACT

A quick release die block system for the gripper of a backup wrench is disclosed. The quick release die block system can include a die block releasably coupled to a die block support. A lock mechanism can include one or more lock pins moveably supported and can be operable with the die block and the die block support, The lock mechanism can also include a lock mechanism interface accessible via a passage in the die block, and can be adapted to releasably secure the die block to the die block support.

35 Claims, 15 Drawing Sheets

QUICK RELEASE DIE BLOCK SYSTEM

BACKGROUND

A top drive is used in oilfield operations to manipulate a wellbore string, such as a drill string or a casing or liner string, The top drive is typically supported in a rig, such as a mast or derrick. The top drive provides torque to the wellbore string to drill a borehole. The top drive can move vertically up and down the rig via a pulley system or on rails, to string or remove pipes.

A top drive can include a backup wrench that can include a gripper device used to grip or position drill pipe during the drilling process. For example, an unattached drill pipe can be coupled by threads to a stump (i.e. an upper end of a string of drill pipe in the earth) by using the gripper to hold the unattached drill pipe in place while the top drive rotates the stump. The gripper of the top drive assembly can use a die block assembly actuated by a cylinder rod or piston to hold the drill pipe in place during the coupling process.

The die block of the gripper requires regular inspection, maintenance and replacement. However, current solutions for mechanically coupling the die block to the gripper can be unsafe, inefficient and can inadequately seal the die block structure from the elements experienced during the drilling process.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
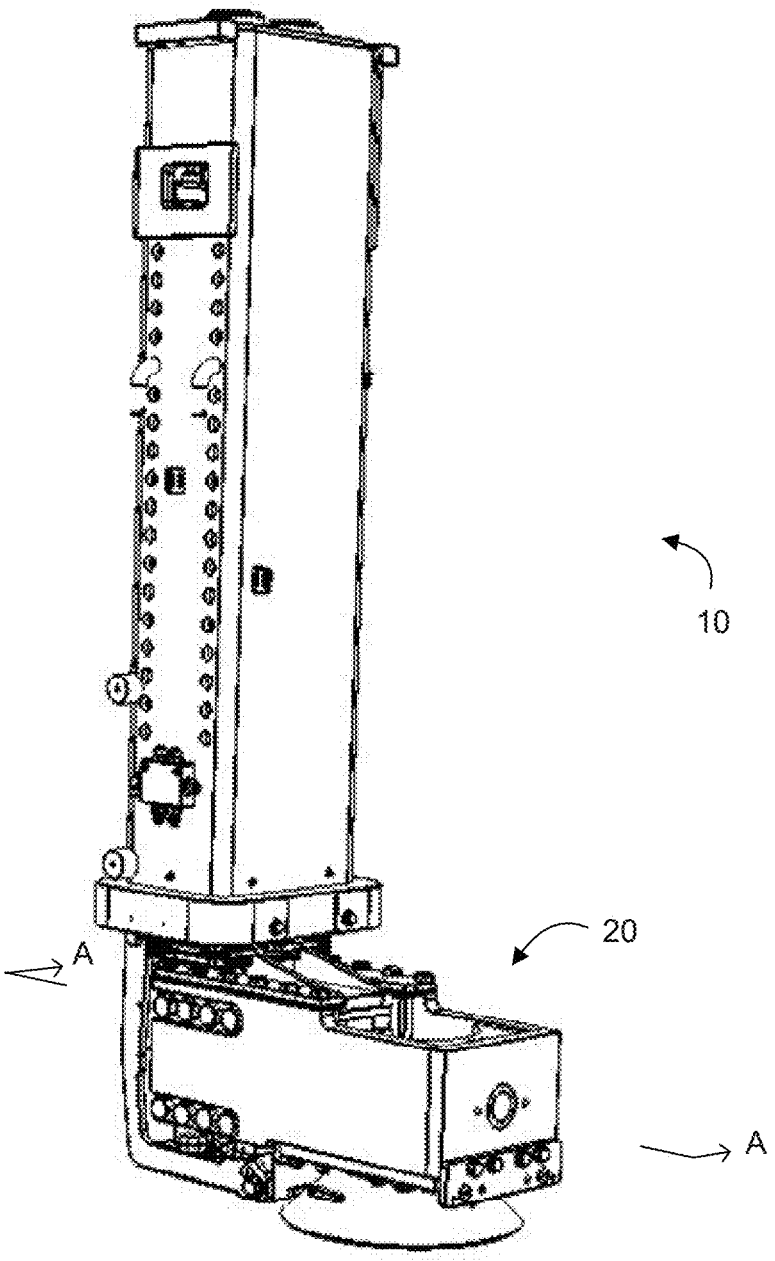
FIG. 1 is an illustration of a top drive system with a gripper in accordance with an example of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness can in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" can be either abutting or connected. Such elements can also be near or close to each other without necessarily contacting each other. The exact degree of proximity can in some cases depend on the specific context.

An initial overview of the inventive concepts is provided below and then specific examples are described in further detail later. This initial summary is intended to aid readers in understanding the examples more quickly, but is not intended to identify key features or essential features of the examples, nor is it intended to limit the scope of the claimed subject matter.

Although top drive grippers have proven effective in the field, the typical gripper includes a set of die block that must be removed and serviced multiple times each week during operation. Current designs and methods for mechanically coupling the die block to the cylinder rod of a piston have many shortcomings. For example, a typical die block can be pinned to the piston using a long pin with a small pin head, the pin being held in place by a cover secured by two bolts. To access the bolts, the cylinder must be energized until the die block clears the frame of the gripper, and the cylinder must remain energized as the die block is removed. This process requires a second operator to manually energize the cylinder and presents potential safety hazards in the event that the cylinder inadvertently de-energizes while the first operator is removing the die block. Some current die block designs also fail to stop mud from the drilling operation from entering the mechanical coupling, which can cause buildup of hardened earth matter and corrosion.

Accordingly, the present disclosure sets forth a quick release die block system for the gripper of a wellbore rig top drive. The quick release die block system allows for efficient removal of the die block from the cylinder without requiring the cylinder to be energized, all while sealing the mechanical coupling from the elements, such as drilling mud. The quick release die block system can include a lock mechanism that is accessed via a passage in the die block, or through the face of the die block. The lock mechanism can be sealed within the piston and the die block to keep the inside clean from the elements, including the mud from drilling operations.

In one aspect, a quick release die block system is disclosed that can include a die block disposed adjacent a piston with a lock mechanism disposed within at least one of the die block and the piston. The lock mechanism can include one or more lock pins moveably supported, and adapted to releasably secure the die block to the die block support. The lock mechanism can also include a lock mechanism interface that is accessible via a passage in the die block. In one aspect, the lock mechanism can include a cam pin and at least one lock pin having a cam surface. The system can also include a key knob engaged with the cam pin of the lock mechanism. The cam pin can rotate when the key knob is rotated, causing the at least one lock pin to move between an unlocked and a locked position.

In an aspect of the present technology, a die block can include a face, a back surface and at least one side surface. The back surface of the die block can have an aperture, and the aperture can have at least one lock notch disposed therein. The quick release die block system can include a piston at least partially disposed in the aperture of the die block, the piston having a transverse bore. A lock mechanism of the system can include a cam pin and at least one lock pin having a cam surface. The at least one lock pin of the lock mechanism can be disposed in the transverse bore of the piston. The lock mechanism can have a locked and an unlocked position. In the locked position, the lock pin of the lock mechanism can extend from the transverse bore of the piston and into the at least one lock notch of the die block. In the unlocked position, the at least one lock pin of the lock mechanism can be retracted within the transverse bore of the piston, allowing the die block to be free of and removed from the piston without energizing the piston.

To further describe the present technology, examples are now provided with reference to the figures. With reference to FIG. 1, one example of a wellbore rig top drive system 10 is illustrated. The system 10 can comprise a gripper 20 that can include a quick release die block system according to the present technology.

Figure 2:
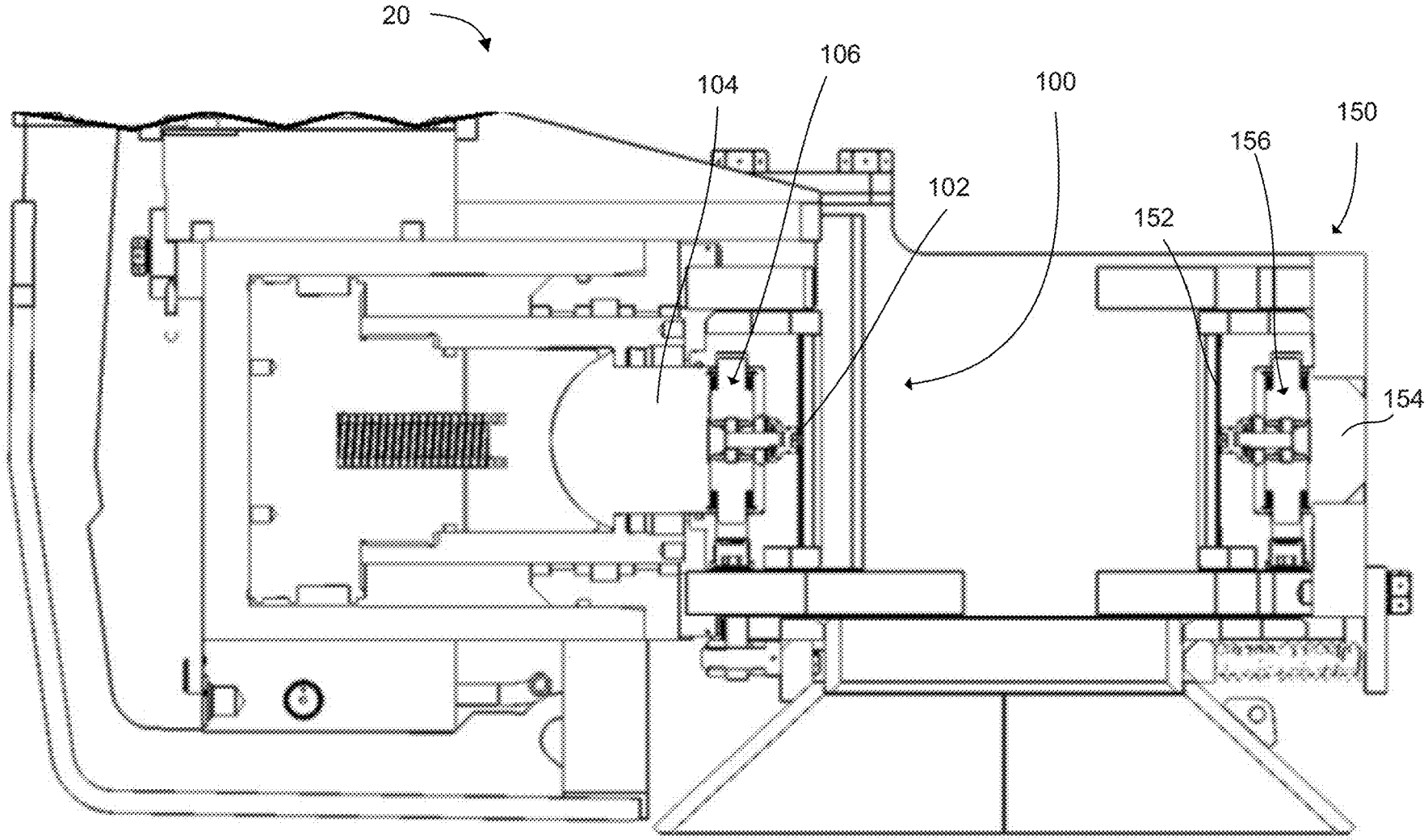
FIG. 2 is a partial cross-sectional view of the gripper of FIG. 1, and the quick release die block system of the gripper, taken along line A-A of FIG. 1, the quick release die block system comprising a quick release die block assembly in accordance with an example.

With reference to FIG. 2, the gripper 20 can include a first quick release die block system 100 and a second quick release die block system 150 that each facilitate efficient removal of an associated die block without requiring a cylinder to be energized. Quick release die block system 100 can include a die block 102, a die block support that couples to and supports the die block 102 within the gripper assembly (e.g., see die block support in the form of a pneumatic or hydraulic piston 104 operable within the first quick release die block system 100, and see die block support in the form of a stationary support 154 operable within the second quick release die block system 150), and a lock mechanism 106. Second quick release die block system 150 can include a die block 152, a stationary support 154 in support of the die block 152, and a lock mechanism 156 also supported about the stationary support 154 (in other words, the stationary support 154 replaces or takes the place of, and functions as it pertains to the locking assembly in a manner similar to, the piston 104 of the first quick release die block system 100).

As described more fully herein, the die block 102 can be releasably coupled to the die block support(e.g., the piston 104). In one aspect, the piston 104 is configured to be energized and moved from a resting position to an energized position. The quick release die block system 100 provides the advantage of releasably securing the die block 102 to the piston 104 without energizing the piston 104. In other words, the die block 102 is releasably secured to the piston 104 when the piston 104 is in a resting position. The lock mechanism 106 can removably couple die block 102 to piston 104, or in other words can be operable with the die block support and the die block 102 to releasably secure the die block 102 to the die block support. Die block 102 can be disposed adjacent piston 104, which can include any arrangement whereby die block 102 and piston 104 are disposed in contact with one another. For example, die block 102 and piston 104 can have surfaces that abut one another. In another example, a portion of piston 104 can be disposed within or overlapping die block 102, with die block 102 surrounding a portion of piston 104. Alternatively, a portion of die block 102 can be disposed within or overlapping piston 104.

Figure 3:
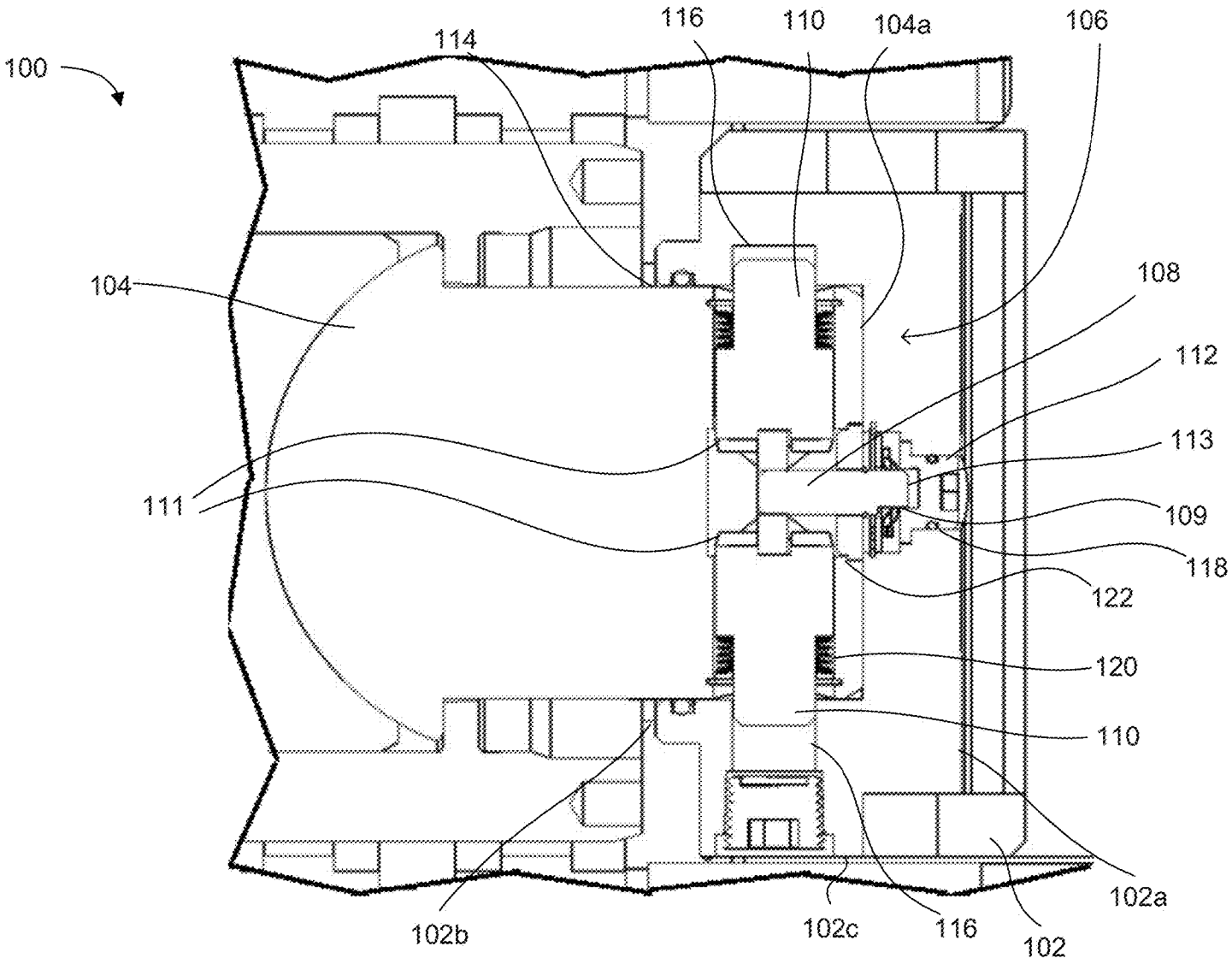
FIG. 3 is a detailed cross-sectional view of the quick release die block system of FIG. 2.

FIG. 3 depicts the first quick release die block system 100, including die block 102 and piston 104. Lock mechanism 106 can include a cam pin 108 operable with one or more lock pins 110, with FIG. 3 illustrating two lock pins 110 opposite one another and configured or adapted to displace in opposing directions, these being movably supported within the transverse bore of the die block. Lock pins 110 can each include a cam surface 111 that receives and engages or interacts with the cams or lobes (see cams or lobes in FIGS. 9-13) of the cam pin 108 to move lock pins 110 laterally as cam pin 108 is rotated. In other words, rotation of cam pin 108 causes lateral displacement of the one or more lock pin 110, including displacement of both lock pins 110 where lock mechanism 106 includes two lock pins 110, these being displaced in opposing directions. A lock mechanism interface 112, which may be a key knob 112, can interface with and engage the cam pin 108, such that when the key knob 112 is rotated, the cam pin 108 and its cam(s) rotates. For example, key knob 112 can include a keyed opening 113 that engages a flat surface 109 of cam pin 108. In other words, key knob 112 can be rotationally engaged with cam pin 108. Key knob 112 can itself be keyed or releasably secured in place to prevent unwanted rotation, as described herein.

Die block 102 can include a face 102*a*, a back surface 102*b*, and at least one side surface 102*c*. In an example, die block 102 can generally take a four-sided shape, such that it will include four side surfaces 102*c*. In other examples, die block 102 can have more or less sides, such as a circle that includes one constant side surface. An aperture 114 can be disposed on back surface 102*b*, and adapted to receive and interface with the piston 104. Aperture 114 can be a cylindrical bore or recess, or can be a bore or recess having any other shape or configuration suitable for interacting with piston 104. In an example, a distal end portion of piston 104 can be disposed or seated within aperture 114. Aperture 114 can further include at least one lock notch 116, which can be a cylindrical bore or a bore having any other shape or configuration suitable for interacting or interfacing with and receiving the lock pins 110. Die block 102 can also include a passage 118, which can comprise an actuator bore, that can extend from the face 102*a* to aperture 114. Passage 118 may extend completely through die block 102 in any form capable of providing access to the lock mechanism 106, as described herein. Passage 118 can be a bore, a slot, a channel, a port, or any other opening sufficient to provide access to the lock mechanism interface 112.

Piston 104 can include a transverse bore 120 which can run or extend laterally across and through the piston 104 to form a through hole. Piston 104 can further include a center bore 122 that is perpendicular to transverse bore 120 and that extends from a proximal end 104*a* of piston 104 to intersect the transverse bore 120. In an example, center bore 122 can be concentric with actuator bore 118 of die block 102. The at least one lock pin 110 of lock mechanism 106 can be moveably disposed in (displaceable within) transverse bore 120. Cam pin 108 can be substantially disposed in center bore 122 and actuator bore 118, with a portion of cam pin 108 disposed within transverse bore 120 and cooperating with cam surfaces 111 of lock pins 110.

The operation of lock mechanism 106 to move lock pins 110 between a locked position and an unlocked position will be described herein, particularly with reference to FIGS. 8-13.

Figure 4:
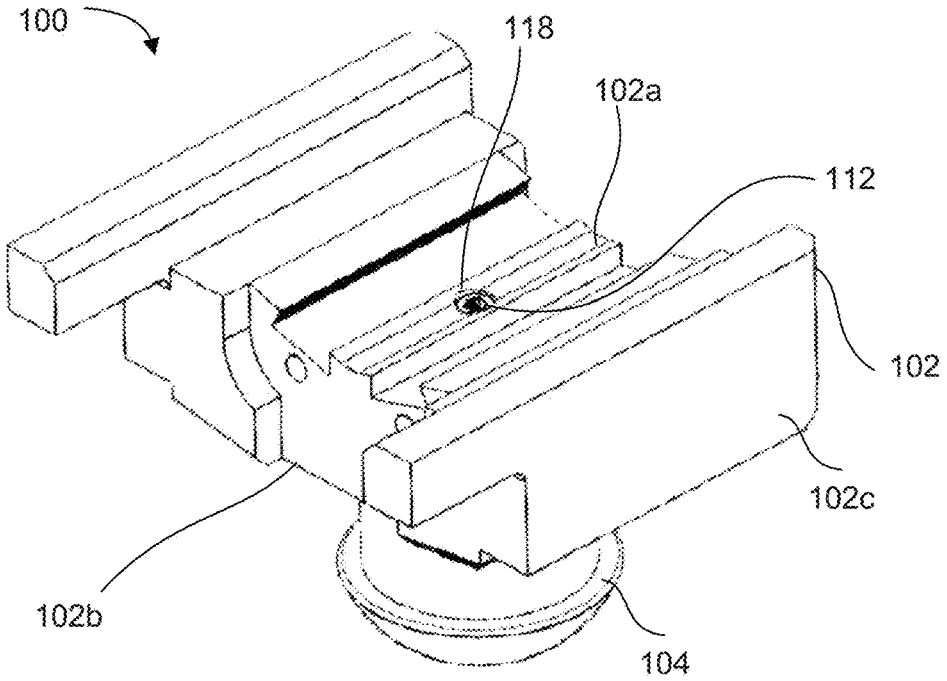
FIG. 4 is a perspective view of the quick release die block assembly of the quick release die block system of FIG. 2.

With reference to FIG. 4, showing the quick release die block assembly as part of and operable within the quick release die block system of FIG. 2, the die block 102 includes face 102*a*, back surface 102*b*, and side surfaces 102*c*. Piston 104 is located and supported about or adjacent back surface 102*b* of die block 102. In one aspect, piston 104 can be disposed within the aperture (not shown, but see FIG. 3) on back surface 102*b*. Key knob 112 can be disposed in actuator bore 118, such that key knob 112 is accessible from the face 102*a* of die block 102. In other words, quick release of the die block 102 is facilitated by the presence of the actuator bore 118 being formed within the die block 102, which bore comprises an access opening formed through the outer gripping surface of the die block 102 that is accessible by an operator from the outer gripping surface or face of the die block 102, and which provides direct access to the key knob 112 and the locking mechanism 106 by the operator. Providing access to the locking mechanism 106 via and through the outer gripping surface or face of the die block 102 provides significant advantages, such as allowing an operator to access the key knob 112 and unlock the locking mechanism 106 to release (or lock to secure) the die block 102 without having to energize any of the components of the quick release die block system 100 (unlike the cylinder that is required to be energized by prior art designs), and without having to access it through the gripper assembly. Another advantage is that a single operator can release and replace a die block without requiring the assistance of another operator.

Figure 5:
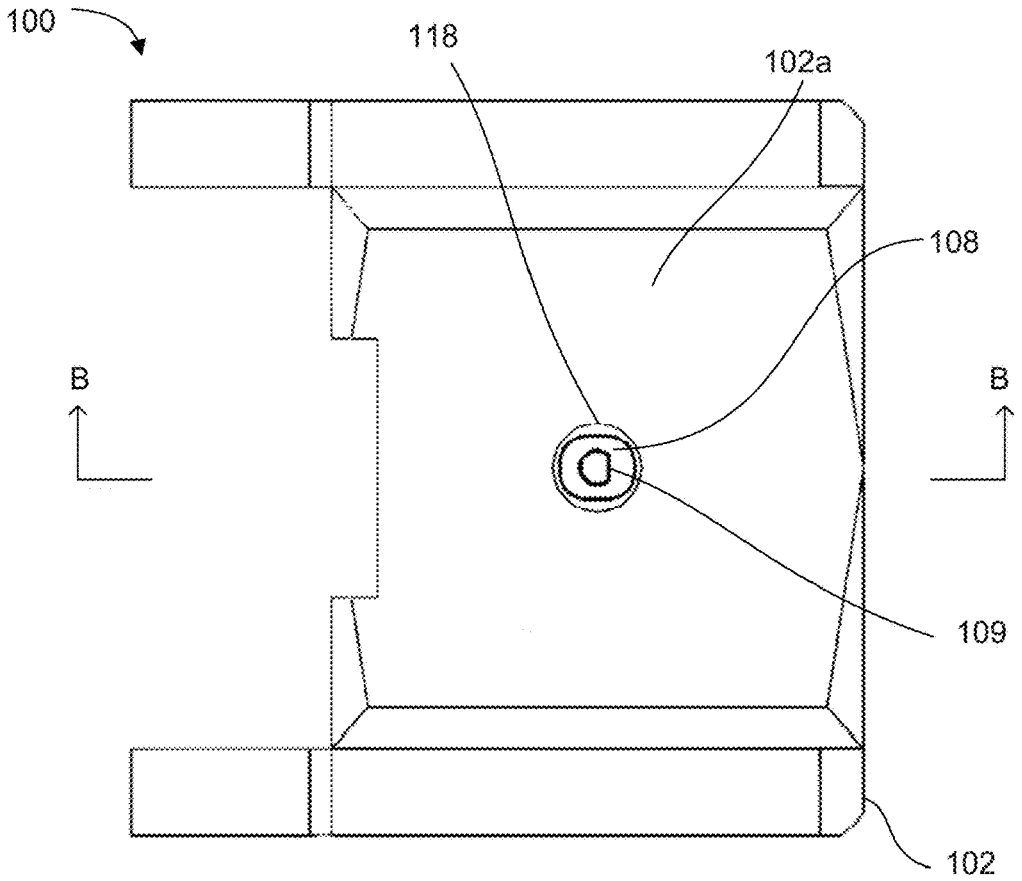
FIG. 5 is a top view of the quick release die block assembly of FIG. 2.

In the view of the example quick release die block system 100 shown in FIG. 5, the key knob 112 is not shown to allow cam pin 108 with flat surface 109 to be shown extending through actuator bore 118 on face 102*a* of die block 102. Actuator bore 118 allows access to lock mechanism 106, which allows the quick release die block assembly/system of the present disclosure to be operated from the face 102*a* (the face adapted to grip a drill pipe) of the die block 102, without requiring the piston to be energized.

Figure 6:
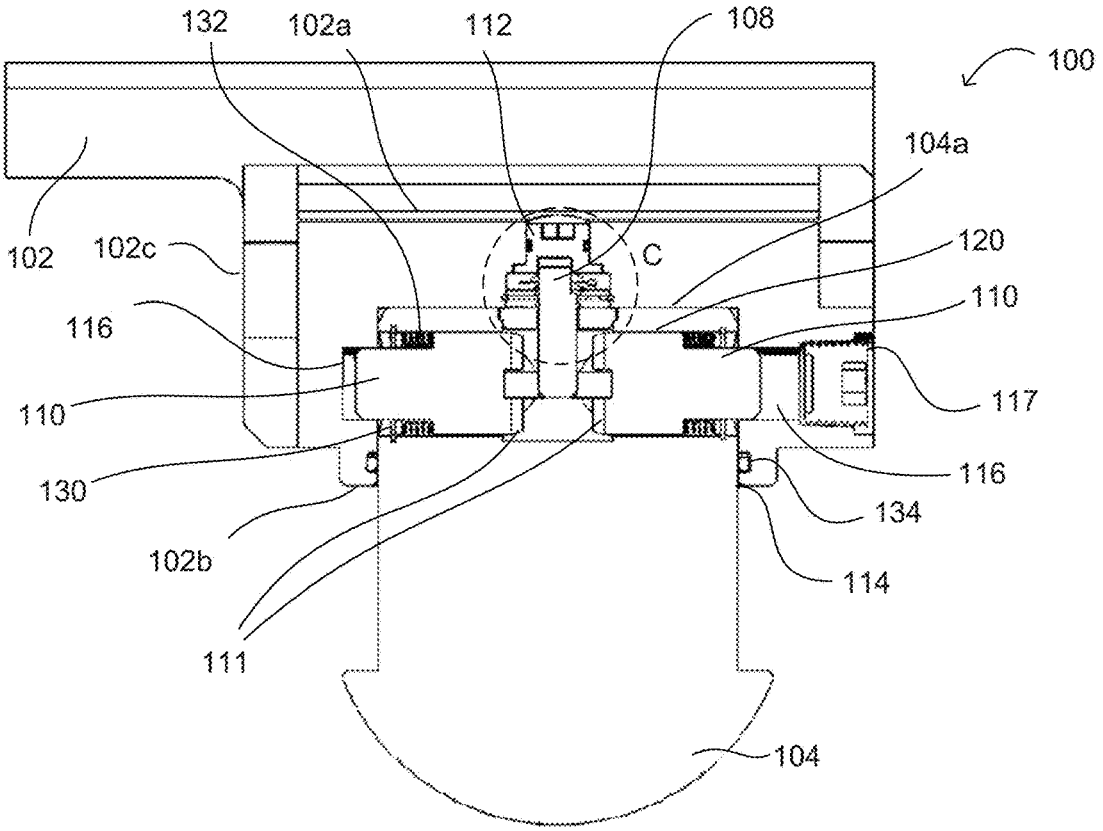
FIG. 6 is a cross-sectional view of the quick release die block assembly of FIG. 2, taken along line B-B of FIG. 5.
Figure 7:
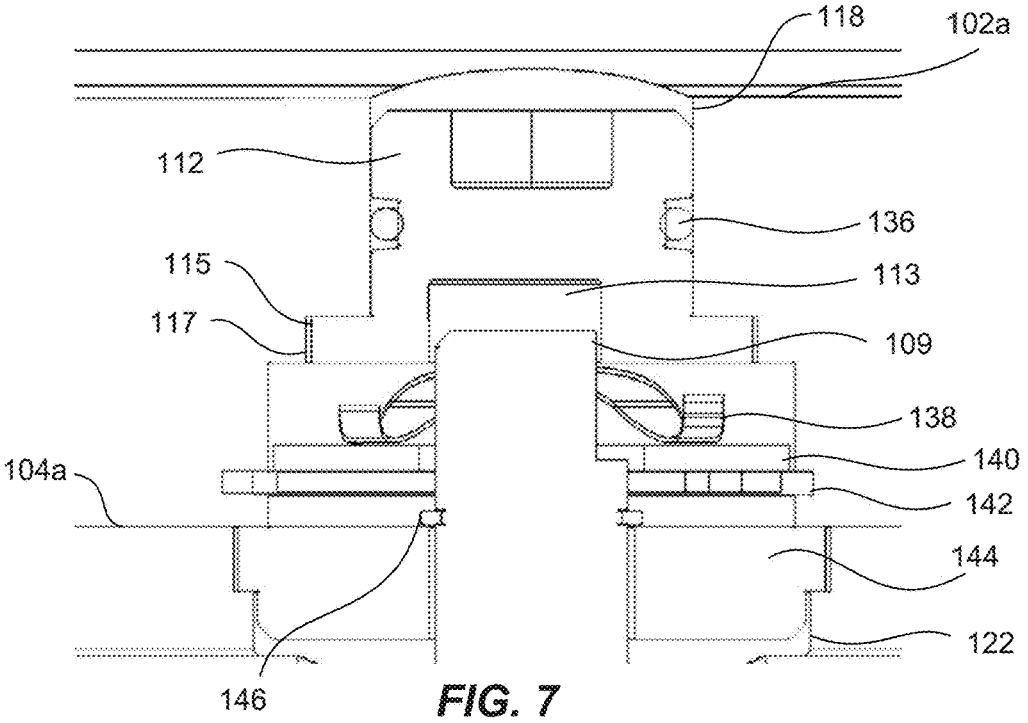
FIG. 7 is a detailed cross-sectional view of the quick release die block assembly of FIG. 2, taken about view C of FIG. 6.

FIGS. 6-7 show a cross-section of the example quick release die block system 100 of the present disclosure. Die block 102 can have a face 102*a*, a back surface 102*b* and at least one side surface 102*c*. Back surface 102*b* can include an aperture 114 formed therein, which can further include one or more lock notches 116 formed therein. In one example, such as that shown, aperture 114 can include two lock notches 116 that are parallel, or that are essentially a bore traversing aperture 114. For example, lock notches 116 can extend to different, respective side surfaces 102*c* of die block 102, forming an inlet or opening that can be capped by plug 117.

A portion of piston 104 can be sized and configured to be received and disposed in aperture 114. Alternatively, piston 104 can be supported about die block 102 in any other manner as contemplated herein, such as without utilizing an aperture such as aperture 114. Piston 104 can include a transverse bore 120 extending through piston 104 to form a through hole. Piston 104 can also include a center bore 122 that can be perpendicular to transverse bore 120 and can extend from a proximal surface 104*a* of piston 104 to transverse bore 120. Transverse bore 120 can be parallel to or align with the at least one lock notch 116 in die block 102.

Quick release die block system 100 can also include a lock mechanism 106 that includes a cam pin 108 and one or more lock pins 110, each having a cam surface 111 about which one or more cams or lobes of the cam pin 108 interface with and slide to cause the lock pins 110 to displace. Indeed, rotation of the cam pin 108, with its associated cams extending in opposing directions to contact and interface with each of the respective lock pins 110, in a first direction can cause the lock pins 110 to displace in a first direction, and wherein rotation of the cam pin 108 in a second direction (or continued rotation in the same direction) can cause the lock pins 110 to displace in a second direction. The cam pin 108 is configured to rotate about and to engage with the cam surface(s) 111 of the respective lock pin(s) 110, which causes the lock pin(s) 110 to move or displace laterally, or in and out away from cam pin 108. In other words, the rotary input of the cam pin 108 translates to linear output or movement of the lock pin(s) 110 as the cams of the cam pin 108 slide against the cam surfaces 111. In the example shown, the cam surface 111 of the lock pin 110 can comprise a slot formed in the lock pin 110 (e.g., see FIG. 10 and the cam surface 111 formed as a slot in the lock pin 110), wherein the slot is configured to receive the cam of the cam pin 108, the slot comprising surfaces extending about the cam of the cam pin 108 when engaged. In this arrangement, the cam pin 108 is effectively secured or locked to the lock pin 110. In other words, the cam pin 108 is prevented from disengaging from the lock pin 110 and moving relative to the lock pin 110. The cam of the cam pin 108 can be configured such that it is received and engaged within the slot forming the cam surface 111 no matter the rotational position (unlocked or locked position) of the cam pin 108. In an example including two lock pins 110, a single cam pin 108 having opposing cams or lobes can be adapted to engage and cause both lock pins 110 to move. As the cam pin 108 is caused to turn one direction, the lock pins 110 will move away from one another, to a locked position as described more fully herein. As the cam pin 108 turns in the opposite direction, or in some cases as the cam pin continues to turn in the same direction, the lock pins 110 will move toward one another to an unlocked position.

The quick release die block system 100 can further include a keeper ring 130 and a biasing component or spring 132 associated with the keeper ring 130 and the lock pin 110. The keeper ring 130 can be an expandable ring that fits and seats within a channel formed in an annular direction within the transverse bore 120 of the piston 104 at a location proximate an opening of the transverse bore 120, and that protrudes into the transverse bore 120 so as to create a seat or stop surface against which spring 132 can exert a force. The distal end portion of the lock pin 110 can be configured to move in and out of an opening formed by the keeper ring 130. In other words, the keeper ring 130 can extend circumferentially or annularly around the lock pin 110. The biasing component or spring 132 can be any known elastic or compliant component for providing an elastic force between two objects. In one example, biasing component 132 can comprise a standard helical spring disposed circumferentially around and about, and seated within, a stepped down shoulder/neck portion of the lock pin 110 (see stepped down shoulder portion of the lock pin in FIG. 3), the helical spring having a first end seated against the keeper ring 130 and the opposite second end seated against a shoulder of the lock pin 110. Biasing component 132 or spring can be disposed between the keeper ring 130 and the lock pin 110, or in some cases a shoulder or notch in the lock pin 110. In this way, biasing component 132 applies a force to the lock pin 110 in a direction inward, and toward the unlocked position, with the biasing component 132 in an expanded state. When cam pin 108 is rotated to engage cam surface 111 and to move lock pin 110 outward to the locked position, the spring force of biasing component 132 is overcome, thus compressing biasing component 132, wherein energy is stored in this compressed state. It is noted that the same type of keeper ring and biasing component can be employed with respect to the second lock pin 110 (see figures).

In an example of the present disclosure, the quick release die block system 100 provides a seal from the elements encountered in the drilling process, including mud, by providing a series of seals on points of access to the lock mechanism. For example, quick release die block system 100 can include a first O-ring 134 disposed between the die block 102 and the piston 104. In one example, the O-ring 134 can be located within the aperture 114, as shown. A second O-ring 136 can be disposed between the key knob 112 and the die block 102. In one example, the a-ring 136 can be located within the actuator bore 118, as shown. O-rings 134, 136 can provide a seal from the elements while allowing the appropriate movement of the features involved. O-rings 134, 136 can be made of any type of sealing material.

In one example, key knob 112 can be configured to prevent accidental rotation of cam pin 108 and the corresponding movement of lock pins 110. For example, key knob 112 can include a keyed opening 113 comprising a flat surface adapted and configured to engage and mate with a flat surface 109 of cam pin 108 (see flat surface 109 in FIG. 10). The engagement and interface between key knob 112 and cam pin 108 can translate all rotation of key knob 112 to rotation of cam pin 108. Key knob 112 can itself be keyed or releasably secured in place to prevent unwanted rotation. For example, key knob 112 can include one or more keyed surfaces 115 that can be engaged with corresponding mating surfaces 117 on die block 102. Key knob 112 can be generally circular or cylindrical in shape, while the one or more keyed surfaces 115 can comprise flat, linear surfaces or surface edges adapted to engage and interface with a corresponding flat, linear mating surface 117 of die block 102. In one example, the one or more keyed surfaces 115 can be defined by respective protrusions extending from an outer surface of the key knob 112, wherein the protrusion(s) comprise the respective keyed surfaces 115. While key knob 112 would otherwise turn or rotate freely, keyed surface 115 and mating surface 117 prevent inadvertent rotation of key knob 112.

Key knob 112 can further be disposed against an expander or biasing component 138 that can apply a force to and bias key knob 112 in a direction toward the keyed, non-rotating position in which keyed surface 115 is in contact with mating surface 117. In one example, to facilitate this function, a washer 140 can be adjacent a keeper ring 142 disposed and seated within a channel of actuator bore 118. Keeper ring 142 and washer 140 provide a surface against which expander 138 can push to bias key knob 112 toward its keyed or non-rotating position. When key knob 112 is depressed against the biasing component or expander 138, key knob 112 is displaced a sufficient distance so as to release the keyed surface 115 from the mating surface 117 (the keyed surface 115 clears the mating surface 117, wherein in this position, key knob 112 can be freely rotated. The key knob 112 can include two or more keyed surfaces 115, each allowing key knob 112 to return to a keyed or non-rotating position in two different rotation positions. For example, key nob 112 can be in a first keyed or non-rotating position when lock pins 110 are in an unlocked position, and then depressed, rotated and released in a second keyed or non-rotating position when lock pins 110 are in a locked position.

Piston 104 can also include a bearing 144 to align cam pin 108 within center bore 122. A stopper, such as a keeper ring 146, can be disposed within a channel in cam pin 108 and adjacent a top side of bearing 144 to prevent cam pin 108 from moving further toward piston 104. Keeper ring 146 can keep cam pin 108 in proper position to engage cam surfaces 111 of lock pins 110, and can also keep flat surface 109 within keyed opening 113 of key knob 112.

Still with reference to FIGS. 6-7, the quick release die block system 100 can be assembled using the following steps. A first keeper ring 130 can be inserted into the transverse bore 120 of piston 104. A first biasing component 132 and a first lock pin 110 can also be inserted through the transverse bore 120 from the side opposite where the first keeper ring 130 was installed. The cam pin 108 can then be inserted through center bore 122, with corresponding keeper ring 146 installed to hold cam pin 108 in place. A second lock pin 11 can then be inserted, followed by a second biasing component 132 and a second keeper ring 130, completing the components installed within the transverse bore and holding all of the components in place. At this stage, cam pin 108 can be rotated to move lock pins 110 in and out of transverse bore 120, as described in connection with the locked and unlocked positions more fully herein.

Separately, die block 102 can be assembled with key knob 112 by inserting key knob 112 through actuator bore 118 from back surface 102*b*. Expander or biasing component 138 can then be inserted, followed by washer 140 and keeper ring 142, which holds the key knob 112 in place. With expander 138 biasing key knob 112 toward a keyed or stationary position, keyed surface 115 can be aligned with mating surface 117 prior to joining the die block with the piston and lock mechanism assembly described above.

Die block 102 with key knob 112 installed will typically be joined to piston 104 and lock mechanism 106 when piston 104 is installed in the gripper of the wellbore rig top drive. With biasing components 132 pushing lock pins 110 toward the center or within transverse bore 120, aperture 114 of die block 102 can be slid over piston 104. After aligning flat surface 109 of cam pin 108 with keyed opening 113 of key knob 112, die block 102 and piston 104 can come together, disposed adjacent one another. Die block 102 can then be locked to piston 104 by actuating lock mechanism 106. As explained herein, lock mechanism 106 is actuated by depressing and rotating key knob 112. Key knob 112 can be rotated using any known driving tool and corresponding tool indent, or screw drive system. In one non-limiting example, key knob 112 can include a hex socket interface, wherein an Allen wrench of corresponding size can be used to interface with and depress and rotate key knob 112. Of course, other interface configurations are possible and contemplated herein.

Figure 8:
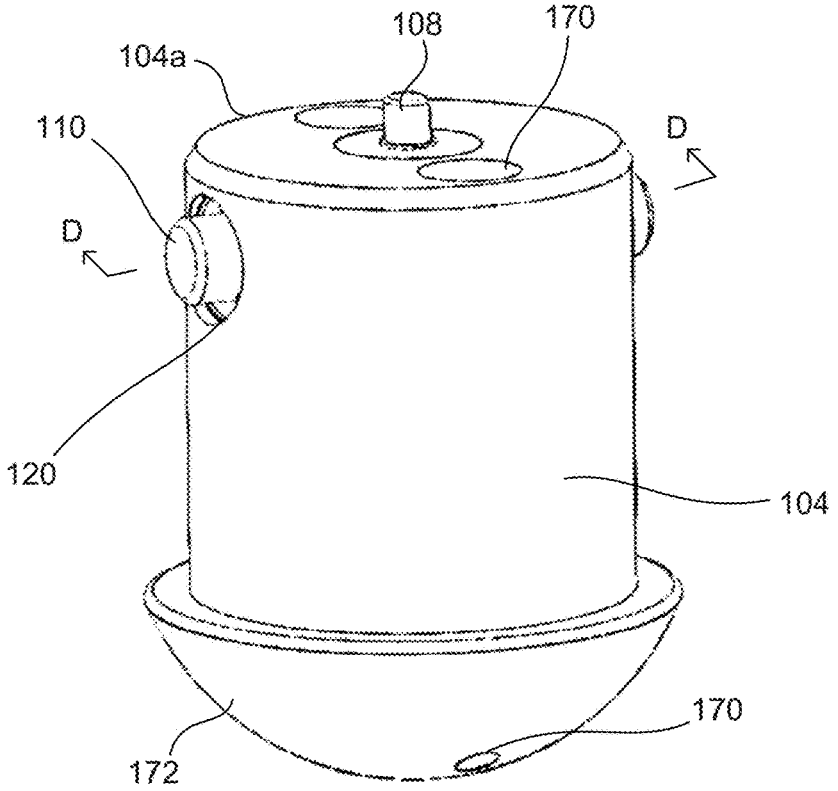
FIG. 8 is a perspective view of the piston and lock mechanism of the quick release die block assembly of FIG. 2, the lock mechanism being shown in the locked position.
Figure 9:
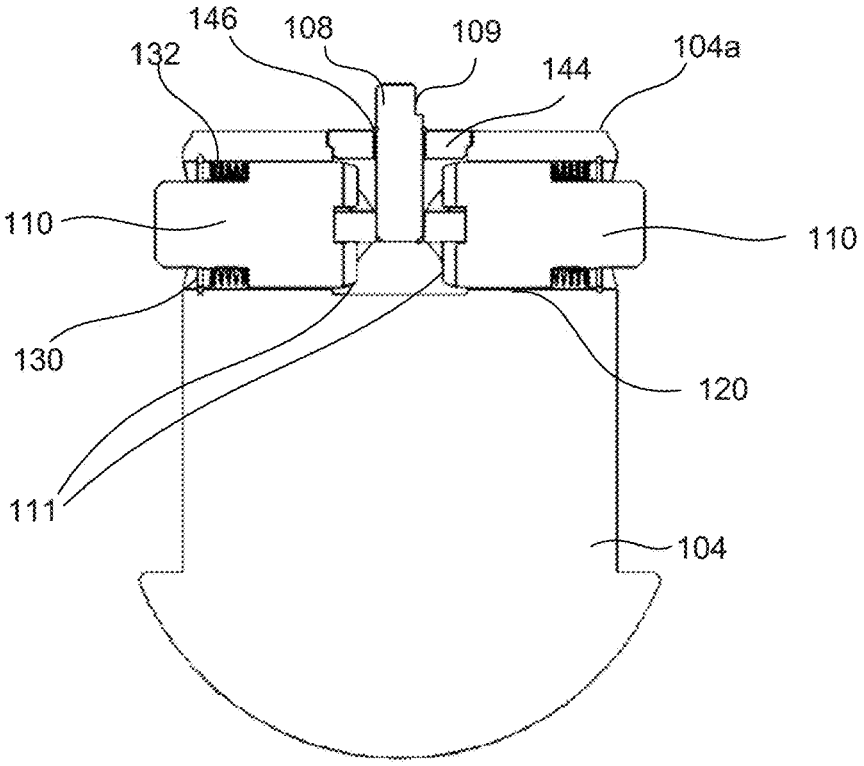
FIG. 9 is a cross-sectional view of the piston and lock mechanism of the quick release die block assembly of FIG. 2, taken along line D-D of FIG. 8.
Figure 10:
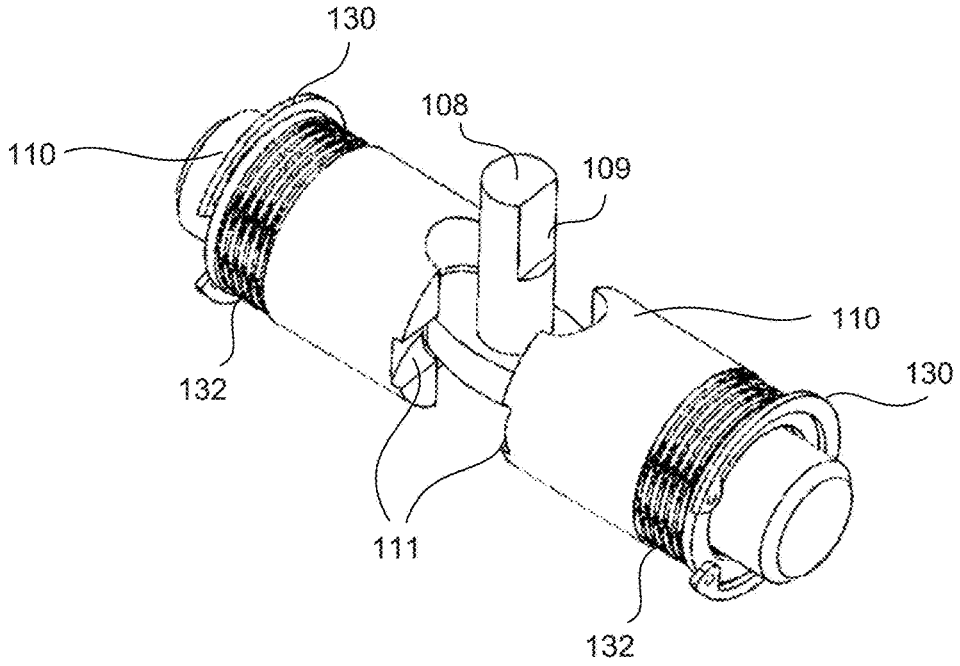
FIG. 10 is a perspective view of the lock mechanism of the piston and lock mechanism of the quick release die block assembly of FIG. 2, the lock mechanism being shown in the locked position.

Continued reference is made to FIGS. 2-7, and specific reference is made to FIGS. 8-10 in which the piston 104 and lock mechanism 106 of the quick release die block assembly are depicted in the locked position. As set forth above, piston 104 includes a proximal end 104*a*, a transverse bore 120, and a center bore 122 extending from the proximal end 104*a* to the transverse bore 120. The center bore 122 can be perpendicular to transverse bore 120. Lock mechanism 106 can be disposed at least partially within piston 104 and can include the cam pin 108 having first and second cams or lobes (see first and second cams extending from the lower end of the cam pin 108 and engaging the cam surfaces 111 of the respective lock pins 110 shown in FIGS. 9 and 10) and at least one lock pin 110 having a cam surface 111 for engaging cam pin 108. Due to the configuration of the cams of the cam pin 108 and their engagement with the cam surfaces 111 of the lock pins 110, rotation of the cam pin 108 can cause the individual cams to slide about the cam surfaces 111 to effect translation or displacement of the lock pins 110. Cam pin 108 can further include a flat surface 109 and a keeper ring 146, and can be disposed at least partially within center bore 122. Lock pin 110 can be disposed within transverse bore 120, where it can engage cam pin 108. Keeper rings 130 and biasing components 132 can also be disposed in transverse bore 120.

Biasing component 132 can provide a force against lock pin 110, biasing it toward the center or unlocked position, wherein substantially all of lock pin 110 resides within transverse bore 120. Lock pin 110 can be moved to the locked position, wherein lock pin 110 is disposed partially within the transverse bore 120 and extending partially outside of the transverse bore. When piston 104 is mated to the die block assembly described herein, lock pin 110 can reside partially within a lock notch in the aperture of the die block (see lock notch 116 shown best in FIGS. 3 and 6). In other words, in the locked position, lock pin 110 extends from the transverse bore 120 of the piston 104 and into the at least one lock notch in the die block 102.

Piston 104 can further include lubrication channels 170, which can be bores extending from a proximal end 104*a* of piston 140 to a distal end (e.g., the end of the piston 104 having a cap 172, such as a cap formed into a mushroom configuration, as shown). The cap 172 can facilitate engagement of the piston 104 with driving members of the gripper in a way that requires lubrication, wherein the quick release die block system facilitates much quicker access to apply such lubrication by facilitating safe, quick and efficient removal of the die block 102.

Figure 11:
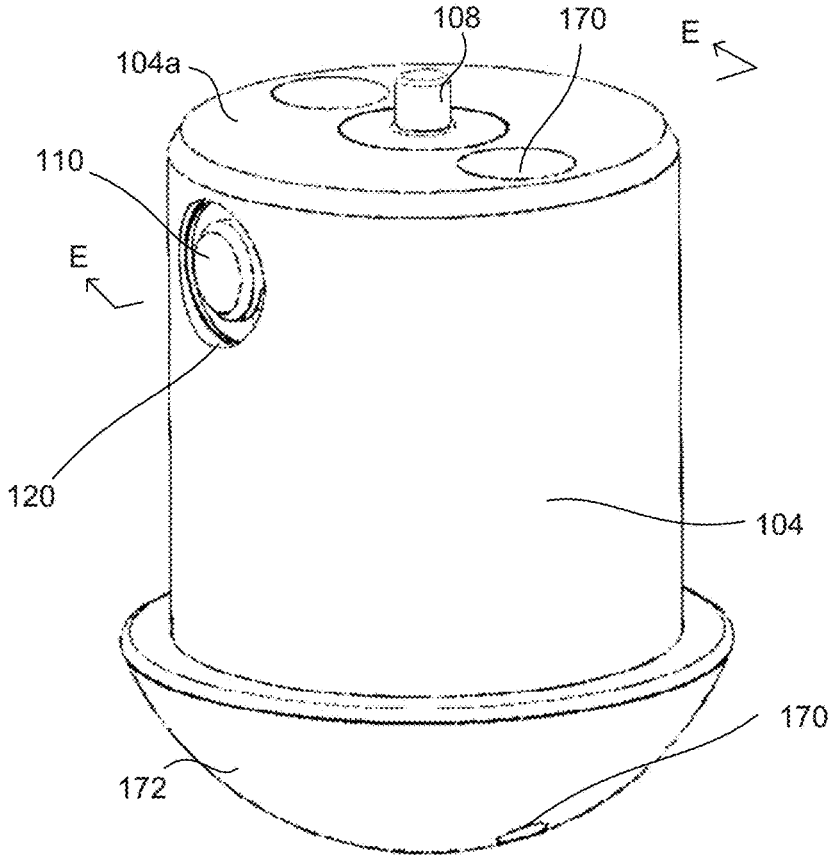
FIG. 11 is a perspective view of the piston and lock mechanism of the quick release die block assembly of FIG. 2, the lock mechanism being shown in the unlocked position.
Figure 12:
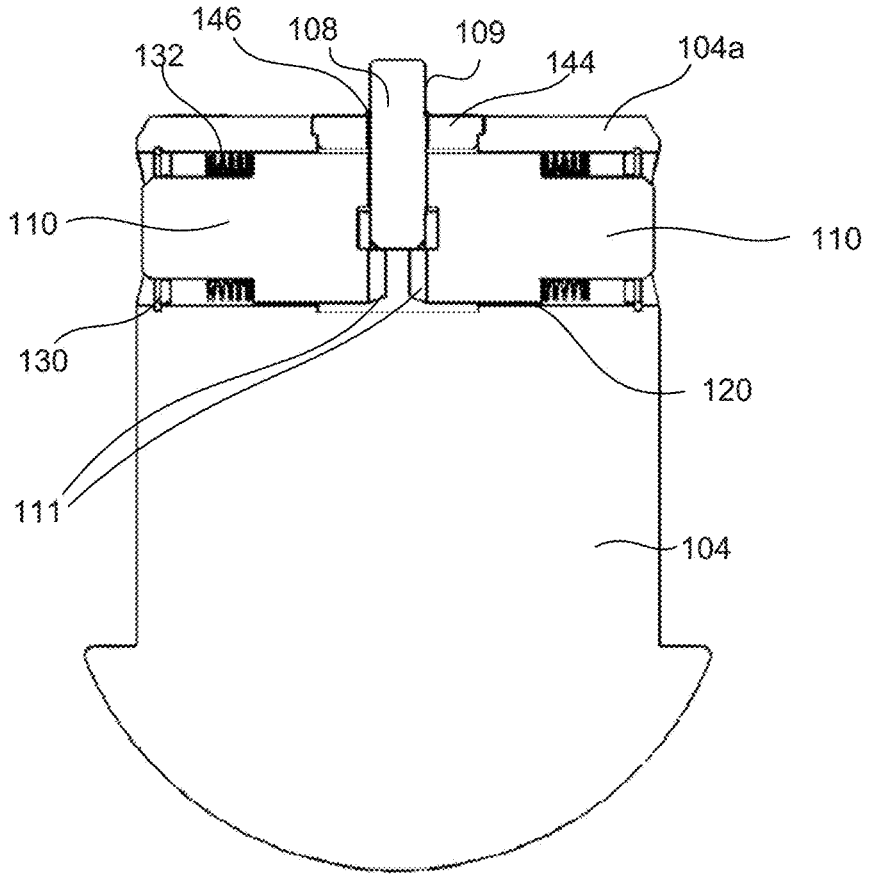
FIG. 12 is a cross-sectional view of the piston and lock mechanism of the quick release die block assembly of FIG. 2, taken along line E-E of FIG. 11, with the lock mechanism in the unlocked position.
Figure 13:
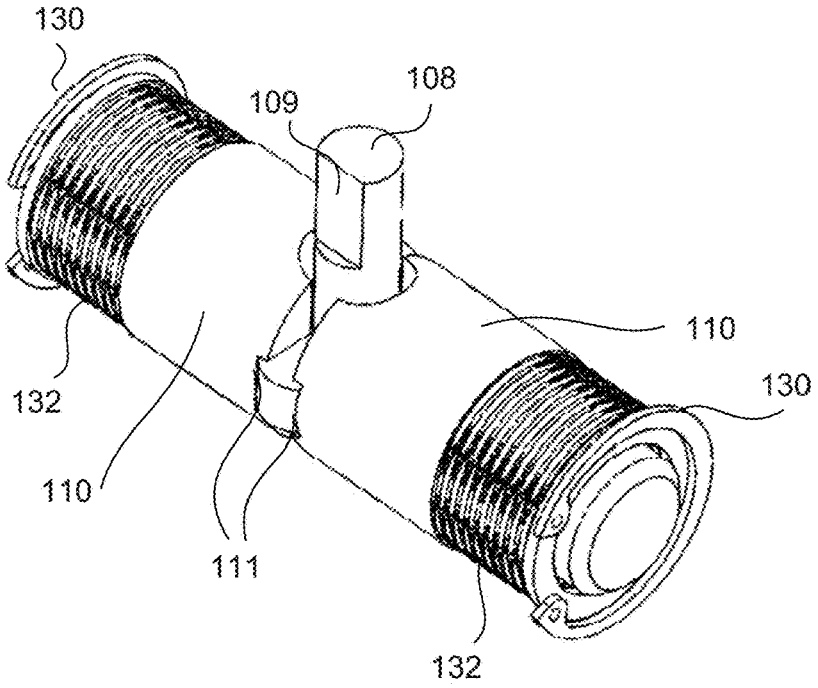
FIG. 13 is a perspective view of the lock mechanism of the piston and lock mechanism of the quick release die block assembly of FIG. 2, the lock mechanism being shown in the unlocked position.

Continued reference is made to FIGS. 1-7, and specific reference is made to FIGS. 11-13 in which the piston 104 and lock mechanism 106 of the quick release die block assembly are depicted in the unlocked position. When in the locked position, as explained above, cam pin 108 interacts with cam surfaces 111 of lock pins 110 to overcome the biasing force of biasing component 132 and move the lock pins 110 outward. To actuate the lock mechanism 106 and return lock pins 110 to the unlocked position, the key knob 112 can be actuated and rotated. Rotation of the key knob 112 rotates the cam pin 108 and moves the lock pins 110 from the locked position to the unlocked position aided by the biasing component 132 exerting a force on and displacing the lock pins 110 in a direction toward one another, and the center of piston 104. With the lock pins 110 in the unlocked position, the die block 102 is freed from the piston 104. The inverse of the above-described steps can be carried out to couple and lock the same or a replacement die block 102.

Figure 14:
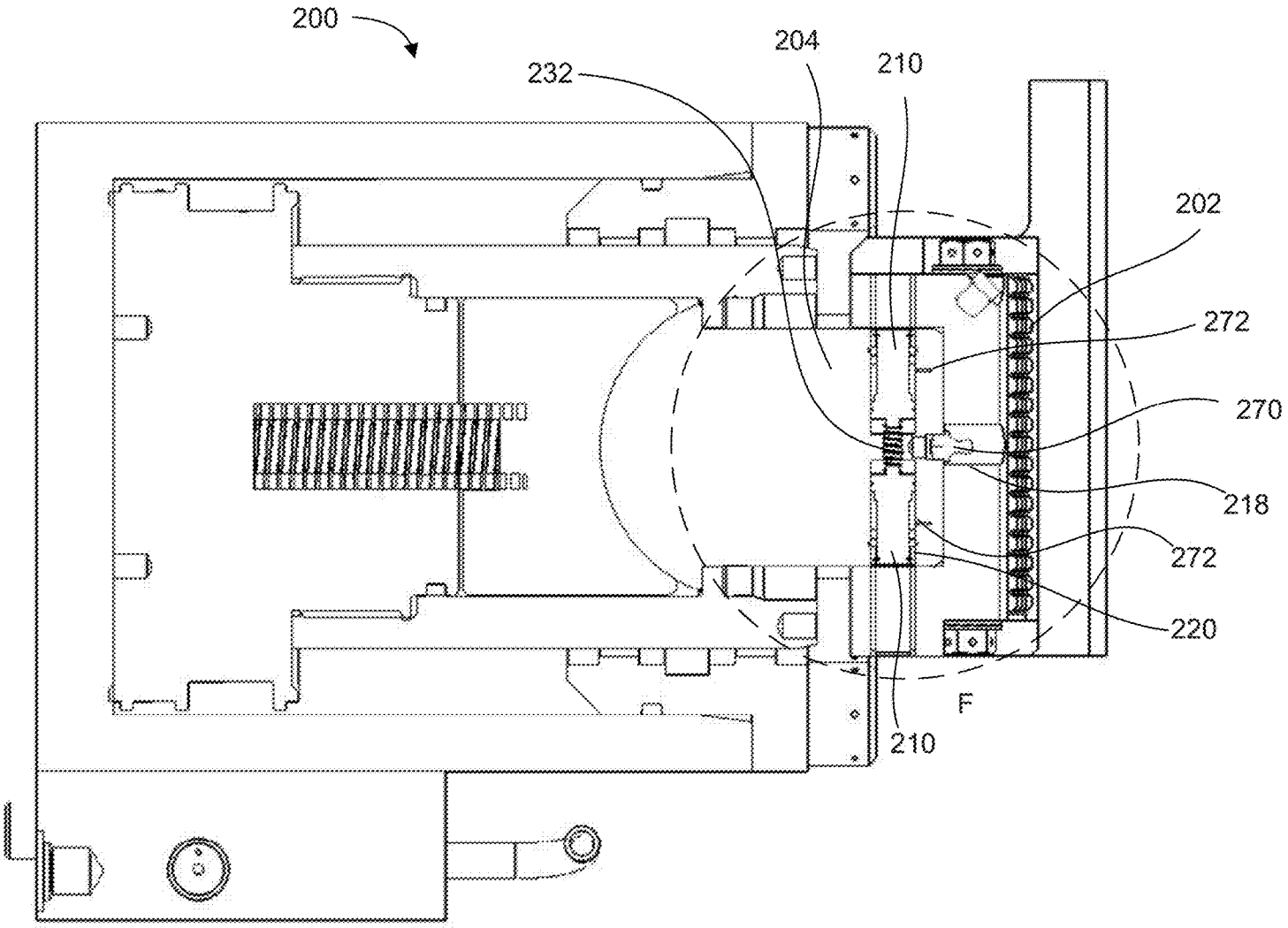
FIG. 14 is a cross-sectional view of a gripper and quick release die block system in accordance with another example of the present disclosure.
Figure 15:
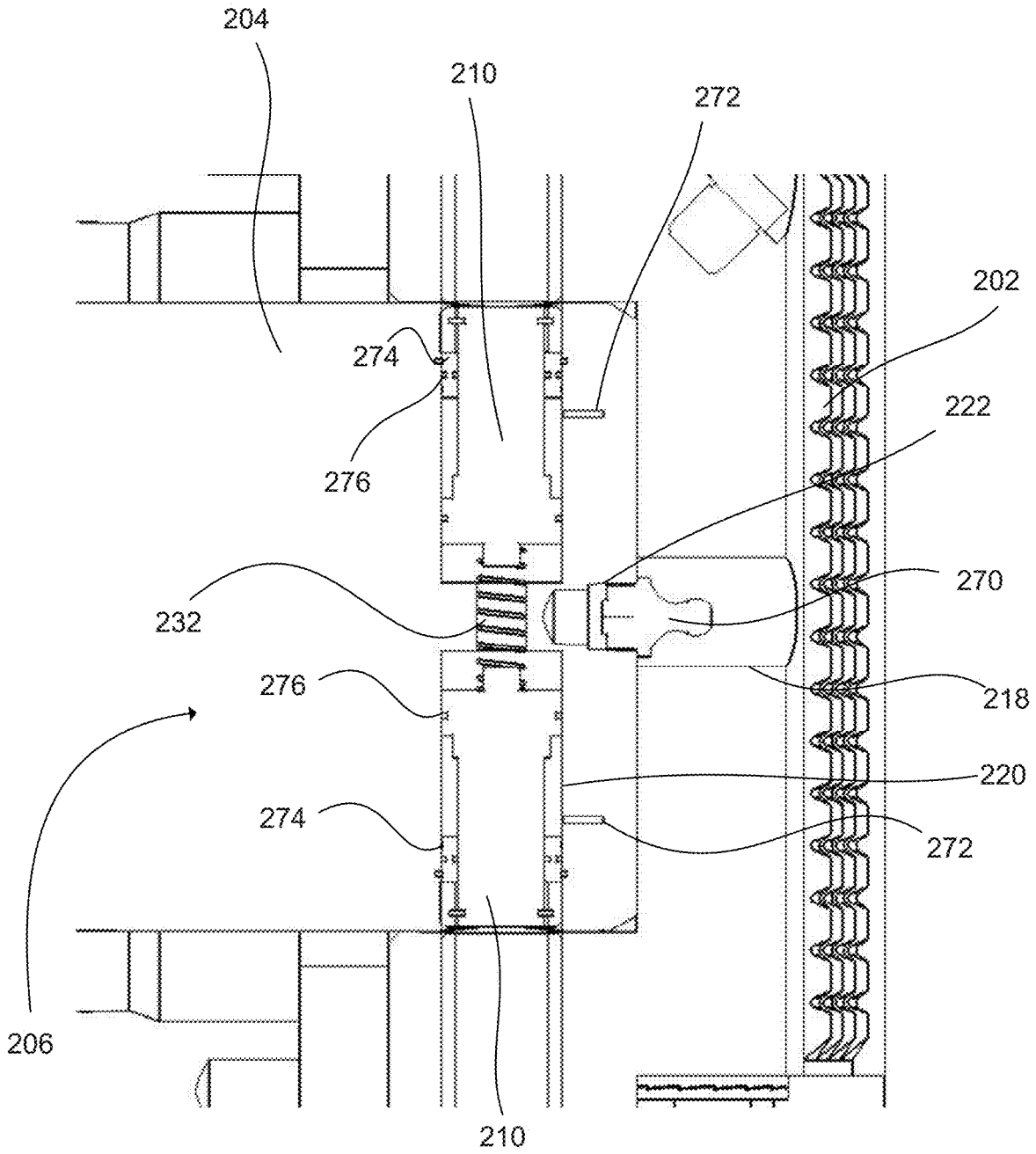
FIG. 15 is a detailed view F of the gripper and quick release die block system of FIG. 14.
Figure 16:
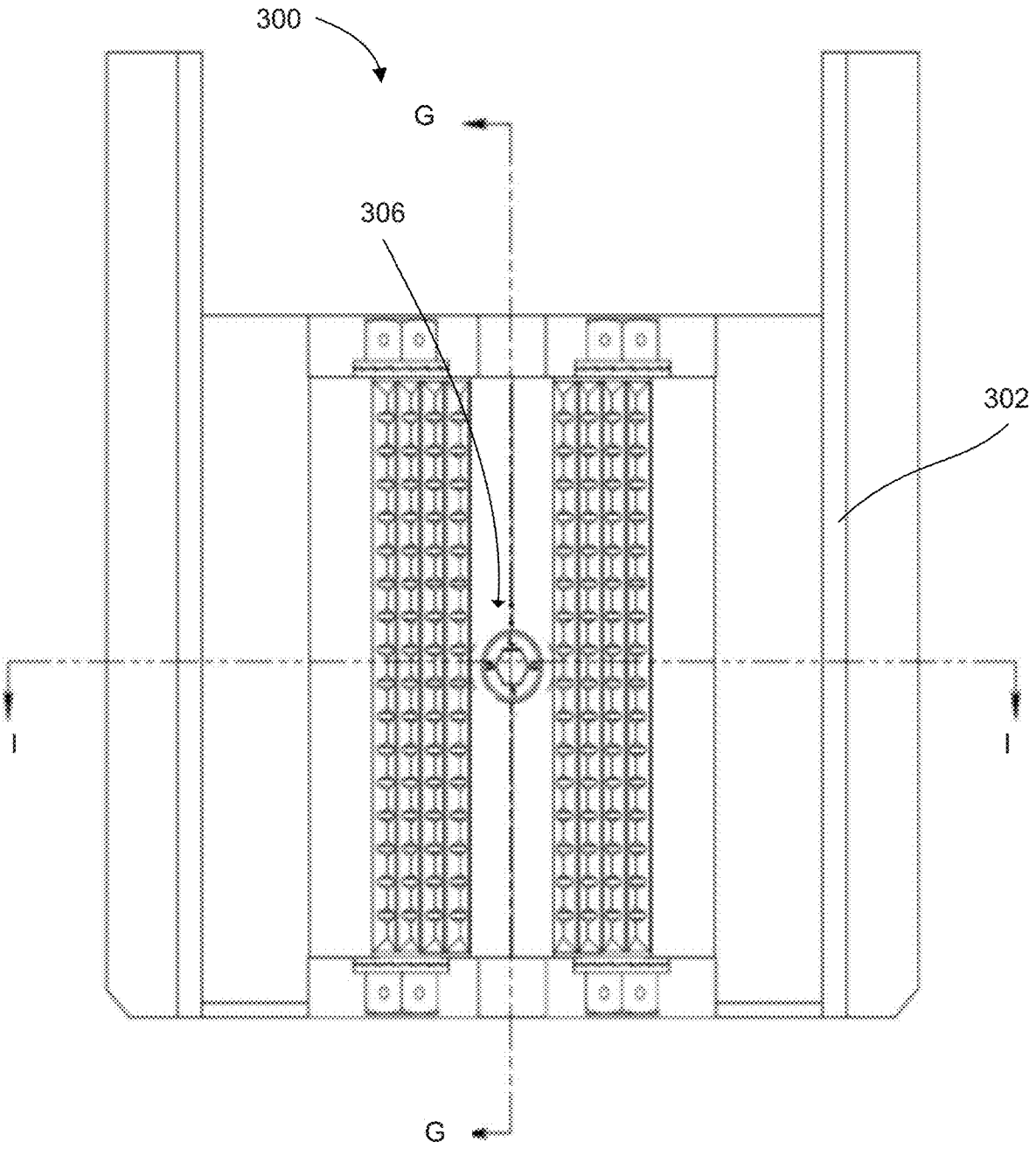
FIG. 16 is a top view of a quick release die block assembly in accordance with another example of the present disclosure.
Figure 17:
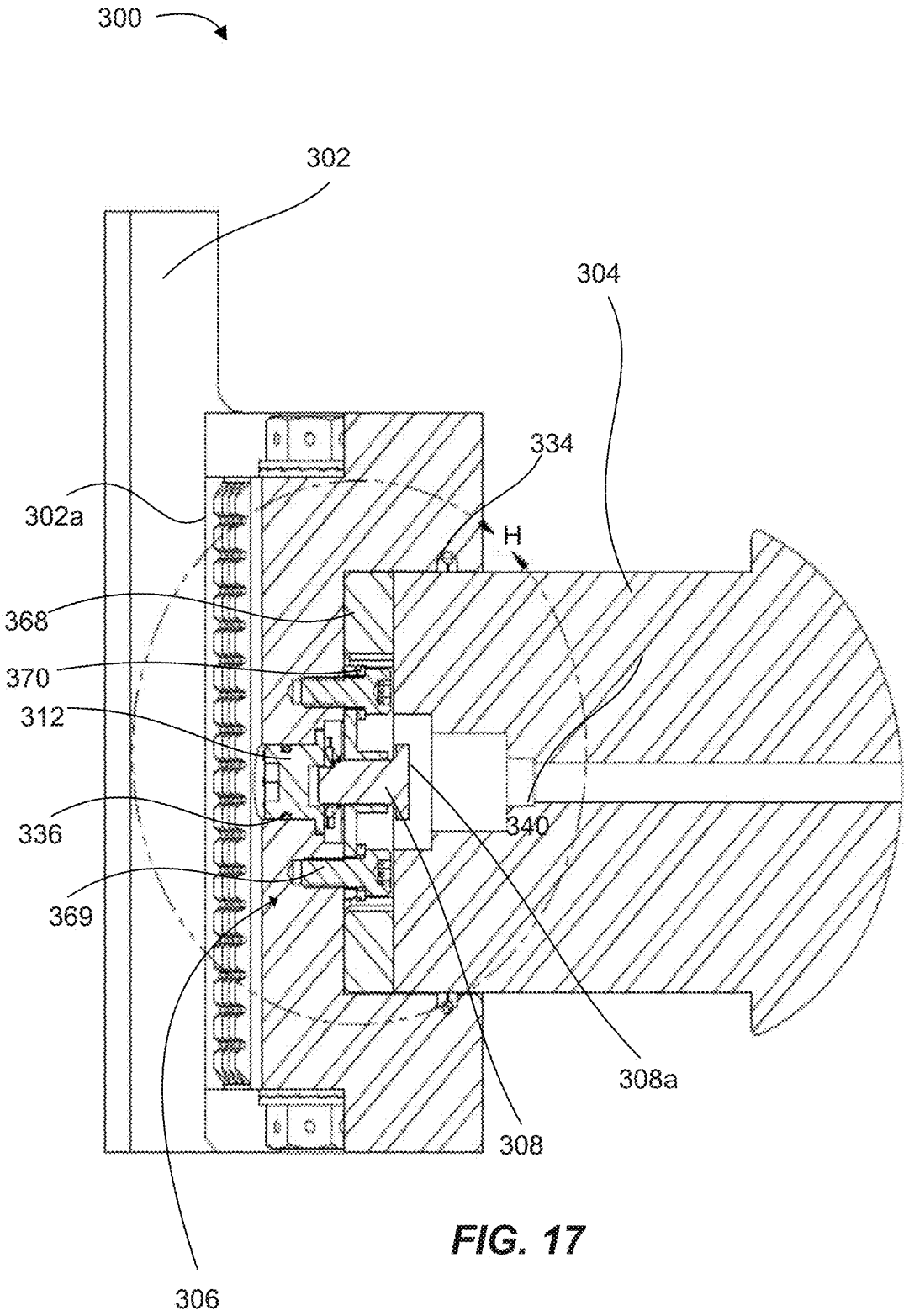
FIG. 17 is a cross-sectional view of the quick release die block assembly of FIG. 16, taken along line G-G.
Figure 18:
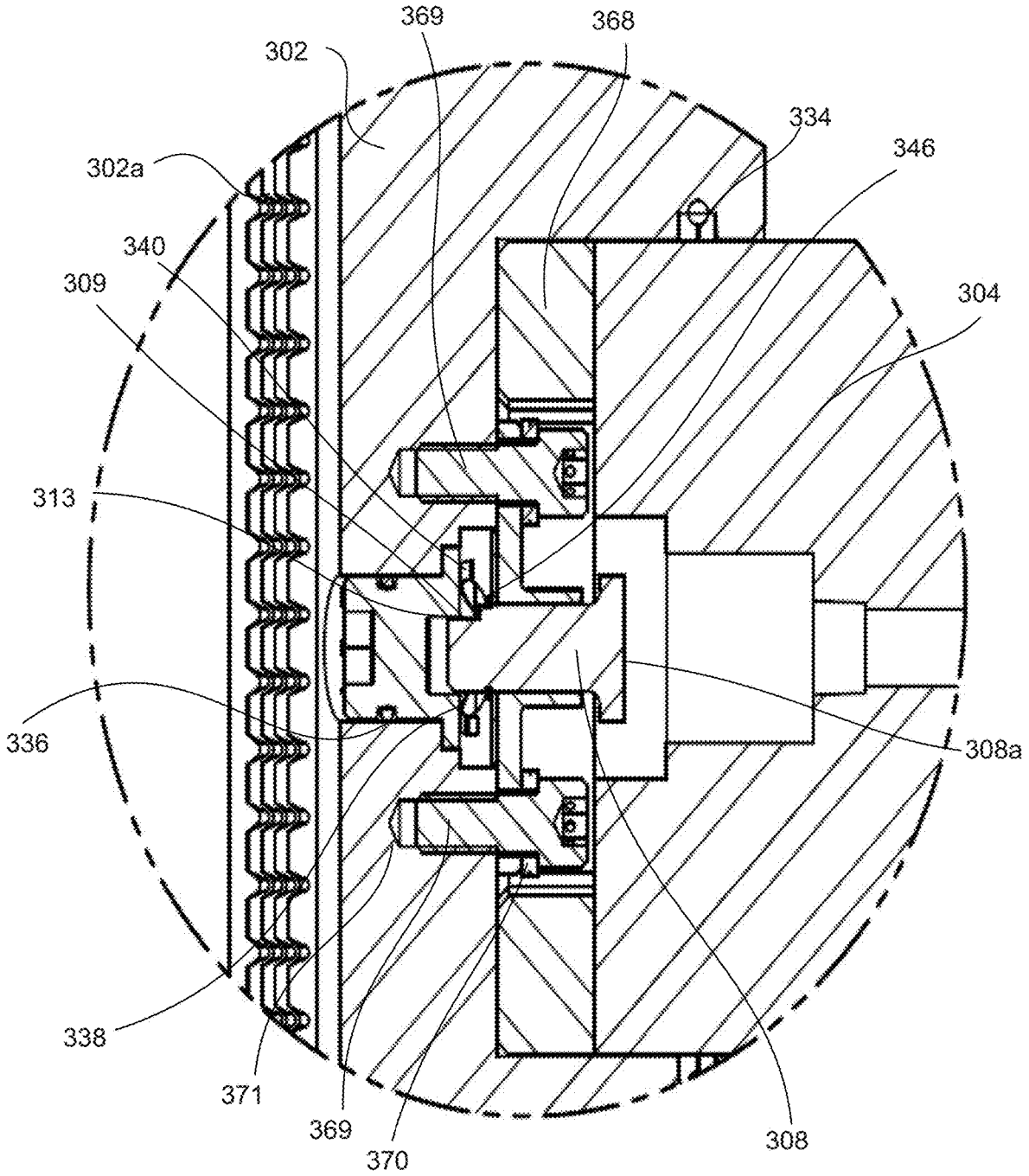
FIG. 18 is a detailed view of the quick release die block assembly of FIG. 16, taken about view H of FIG. 17.
Figure 19:
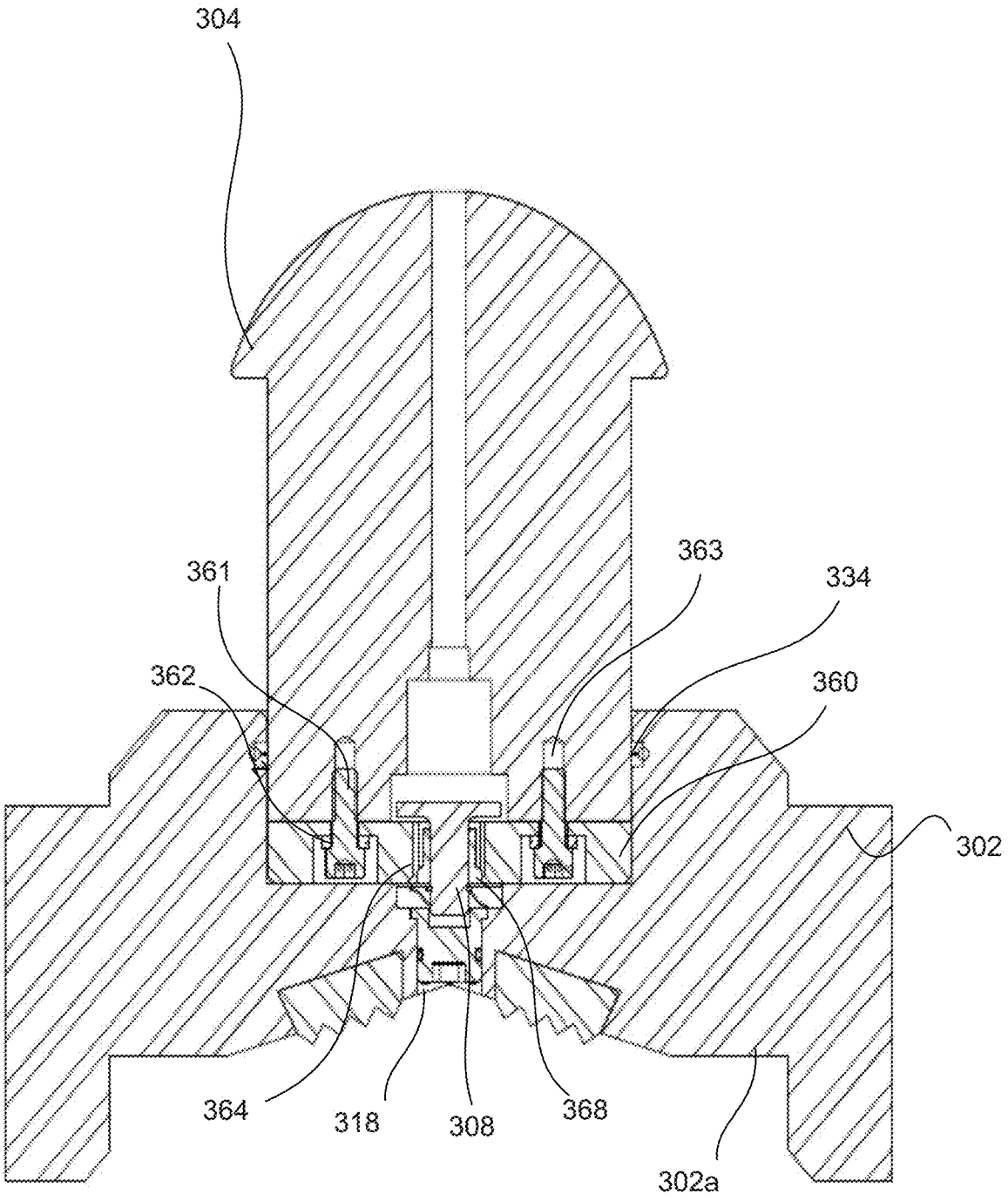
FIG. 19 is a cross-sectional view of the quick release die block assembly of FIG. 16, taken along line I-I.
Figure 20:
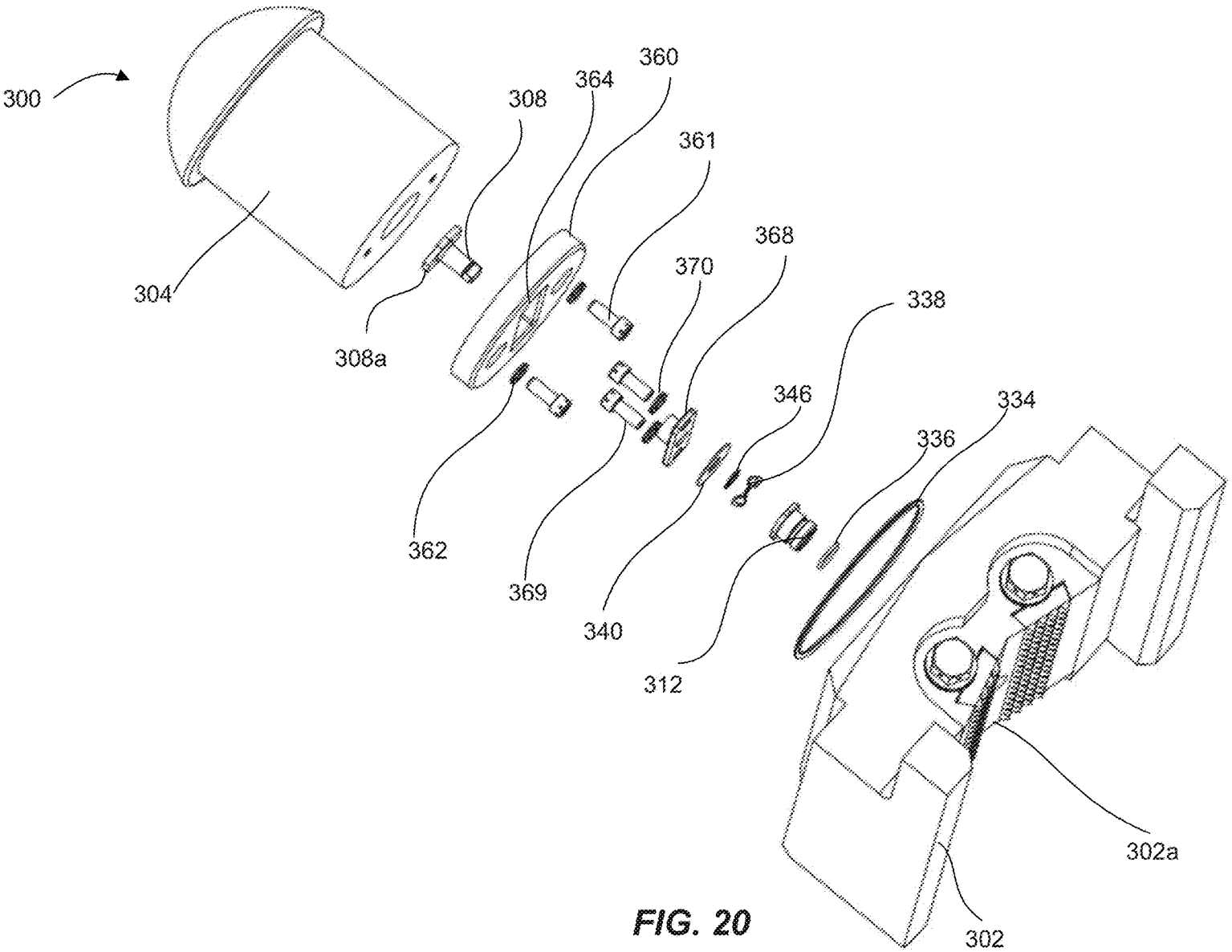
FIG. 20 is an exploded perspective view of the quick release die block assembly of FIG. 16.

FIGS. 14-15 depict a quick release die block system 200 according to another example of the present technology. Quick release die block system 200 can comprise a pneumatic system whereby a die block 202 is releasably attached to a die block support (e.g., piston 204) using a lock mechanism 206 that is actuated using pressurized fluid, such as pneumatically or hydraulically. In one example, piston 204 can include a transverse bore 220 in which one or more lock pins are disposed. In the example shown, the quick release die block system 200 can comprise a pair of locking pins 210 disposed within the transverse bore 220. Lock pins 210 can be biased outward or toward the locked position by biasing component 232, such as a coil or other type of spring. A fluid (e.g., pneumatic) intake member or device 270, such as a male quick coupler for pneumatic systems, can be disposed and supported within an actuator bore 218 of the die block 202 and a center bore 222 of the piston 206. The fluid intake device (shown as coupler 270) can be connected to (i.e., in fluid communication with) a series of channels 272 that can lead to, and which are in fluid communication with, transverse bore 220 between lock pins 210 and a stationary block 274. Lock pins 210 can be moved toward the unlocked position, or toward the center, by applying a pneumatic pressure through coupler 270. Air will travel through channels 272 into transverse bore 220 and pressurize the space between stationary blocks 274 and lock pins 210. Lock pins 210 can be energized (i.e., caused to displace) and pushed against the biasing component 232 in a direction toward the center by the pneumatic pressure, thereby unlocking the quick release die block system 200 and facilitating the release of die block 202 from piston 204. A series of O-rings 276 can be supported about the lock pins 210 within the transverse bore 220 to pneumatically seal the space in transverse bore 220 between stationary blocks 274 and lock pins 210.

In one aspect of quick release die block system 200, a fluid intake device in the form of a valve can be used in place of coupler 270 to provide pneumatic access to lock mechanism 206 while sealing lock mechanism 206 from the elements, including mud. In other aspects of the present technology, any means can be employed for applying a pneumatic pressure to the outside of lock pins 210 to force biasing component 232 to compress and move lock pins 210 to the unlock position.

FIGS. 16-20 depict a quick release die block system 300 according to another example of the present technology. System 300 includes a die block 302 releasably coupled to a die block support 304, which can be a piston. Die block 302 can include a passage 318 that can extend from a face 302*a* to an aperture 314 of die block 302. System 300 also includes a lock mechanism 306, which can include a lock pin 308 rotatably supported within the passage 318 of the die block 302. Lock pin 308 may be similar in some aspects to cam pin 108 of FIGS. 1-13 described herein. For example, Lock pin 308 can include a flat surface 309 for engaging a key knob 312. Key knob 312 can include a keyed opening 313 that engages flat surface 309 of lock pin 308. Lock pin 308 can be operable between a locked and an unlocked position, and may be actuated between the locked and unlocked positions by a lock mechanism interface such as key knob 312.

The quick release die block system 300 can further comprise a retainer plate 360 configured to be coupled to die block support 304 by fasteners (e.g., bolts 361 and washers 362) that attach to support taps 363 disposed in die block support 304. Retainer plate 360 can include a slot 364, which can be a latch slot or a latch notch, and which may function similar in some aspects to lock notch 316 of FIGS. 1-13 described herein. Slot 364 may be configured, dimensioned and adapted for receiving and allowing lock pin 308 to pass through slot 364 when lock pin 308 is in an unlocked position. Slot 364 may further be configured, dimensioned and adapted to prevent lock pin 308 from passing through slot 364 when lock pin 308 is in a locked position.

In some aspects, lock pin 308 can include a latch projection 308*a*, which can be disposed on the distal end of lock pin 308. Latch projection 308*a* can be configured, dimensioned and adapted to engage lock slot 364 or any other lock surface, as described herein. For example, latch projection 308*a* may be an oblong diamond shape, a rectangular shape, or any other shape suitable for engaging a lock slot as described herein. In an example, latch projection 308*a* is longer in one dimension (e.g., a length dimension) than it is in a second dimension perpendicular to the first dimension (e.g., a width or lateral dimension), such that it can pass through slot 364 when pin 308 is in the unlocked position, but engages retainer plate 360 and is prevented from passing through slot 364 when pin 308 is in the locked position.

Die block 302 is thus releasably coupled or attached to die block support 304 by way of lock pin 308 and retainer plate 360. When die block 302 is removed from die block support 304 by actuating lock mechanism interface 312, lock pin 308, along with its housing 368, remain operably connected or attached to die block 302. Retainer plate 360 similarly remains operably connected to die block support 304 when the die block 302 is removed. In this way, retainer plate 360 and lock pin 308 with housing 368 are added to die block 302 and die block support 304 to provide for a releasable coupling between die block 302 and die block support 304. In one example, conventional die block and die block supports can be slightly modified or adapted, rather than redesigned completely, to accommodate the components of quick release die block system 300 and can be retrofit or transformed from a common die block system to a quick release die block system.

The quick release die block system 300 also includes a lock pin housing 368 coupled to the die block 302 by fasteners (e.g., bolts 369 and washers 370) that secure into die block taps 371. Lock pin housing 368 can be configured, dimensioned and adapted to rotatably support lock pin 308 in a passage 318 of die block 302. For example, a keeper ring 346 can be disposed in a channel of pin 308 and can reside between housing 368 and die block 302 to retain pin 308.

As described with other examples herein, die block system 300 also can include a washer 340, and a biasing component 336 or spring can be disposed between key knob 312 and housing 368. The biasing component can bias key knob into a locked position in die block 302 as described herein, requiring key knob 312 to be depressed before key knob 312, and pin 308, can be turned. An O-ring 334 can be disposed between die block support 304 and die block 302, and an O-ring 336 can be disposed between key knob 312, or any other lock mechanism interface, and passage 318 of die block 302.

In an example, and as will be understood based on the description herein, key knob 312 can be configured to actuate lock mechanism 106, including, without limitation, by way of a hand tool. In an example of quick release die block system 300, the lock mechanism interface, such as key knob 312, may include an opening defining an interface configured to receive a hand tool, such as a hex key. The surface or face of the interface or knob may include inscriptions indicating whether the interface or knob is in the locked or unlocked position, such as "U" or "L."

Other examples of the present technology will be understood by those of ordinary skill in the art based on the present disclosure. For instance, it will be understood that a quick release die block assembly can include a lock mechanism that is at least partially, or fully, disposed within one or both of a die block and a piston. In one aspect, the lock mechanism can be disposed within the die block and lock pins can project into lock notches in the piston to releasably secure the die block to the piston. In another aspect, each of the die block and the piston can include one or more lock pins that project into a lock notch in the other component. Such lock pins can be actuated by a single lock mechanism, or by separate lock mechanisms.

With reference again to FIG. 2, second quick release die block system 150 for quick release of the second die block 152 can include each of the components disclosed herein with reference to quick release die block system 100. In one aspect of the technology, the lock mechanism of second quick release die block system 150 can be accessed through the face of the second die block 152, as disclosed herein. In another aspect, the lock mechanism of second quick release die block system 150 can be accessed from outside the frame of the gripper, or from an outside surface of stationary support 154. As will be understood based on the present disclosure, the components of the quick release die block system could be configured to facilitate access to the key pin from outside of the gripper rather than from the face of the die block.

In yet other aspects of the present invention, access to the lock mechanism of a quick release die block system can be provided at any location convenient to any appropriate application. In some cases, access to the lock mechanism, whether through a key knob or otherwise, can be provided through the side of a piston, the side of a die block, or any other configuration based on the arrangement of the lock mechanism as disclosed or contemplated herein.

In accordance with one example of the present technology, a method for releasably coupling a die block to a support, is disclosed and can include providing a die block support and providing a die block releasable coupled to the die block support. The method can further include providing a lock mechanism operable with the die block support and the die block, the lock mechanism comprising one or more lock pins moveably supported, and adapted to releasably secure the die block to the die block support, the lock mechanism further comprising a lock mechanism interface that is accessible via a passage in the die block. The method can then include actuating the lock mechanism interface to engage the one or more lock pins and couple the die block to the die block support, and actuating the lock mechanism interface to disengage the one or more lock pins to release the die block from the die block support.

In aspects of the method, the die block support can include a piston, and the die block can be releasably secured to the piston without energizing the piston. In other aspects, the die block has a face and the lock mechanism interface is accessible from the face of the die block. In yet other aspects, the die block can also have a back surface and at least one side surface, the back surface having an aperture, and a portion of the die block support can be disposed in the aperture of the die block.

The method for releasably coupling a die block to a support can further include providing a retainer plate coupled to the die block support, the retainer plate comprising a slot. The lock pin can be operable between a locked and an unlocked position with the lock pin engaging the slot of the retainer plate in the locked position. In other aspects, the method can further include a lock mechanism having a cam pin and one or more lock pins having a cam surface. In aspects of the method, the lock mechanism interface engages with the cam pin of the lock mechanism to rotate the cam pin when the lock mechanism interface is rotated, and rotation of the cam pin causes the one or more lock pins to move between an unlocked and a locked position. In yet other aspects of the method, the lock mechanism interface can comprise a pressurized fluid intake device.

In other aspects, another method for removably attaching a die block to a piston is disclosed. The method can include providing a die block disposed adjacent a piston and providing a lock mechanism comprising a cam pin and at least one lock pin having a cam surface, the at least one lock pin disposed within at least one of the die block and the piston. The method can further include providing a key knob rotationally engaged with the cam pin. The concepts and interactions between these components, as described in detail herein, can all further be included as steps in the method of removably attaching a die block to a piston.

In one aspect, the method can further include rotating the key knob to rotate the cam pin and actuate the at least one lock pin to a locked position, and can include rotating the key knob to rotate the cam pin and actuate the at least one lock pin to the unlocked position. As disclosed herein, the die block of the method can include a face, a back surface, and at least one side surface, the back surface having an aperture, the aperture having at least one lock notch disposed therein, and wherein a portion of the piston is disposed in the aperture of the die block. In an example, the piston can include a transverse bore with the at least one lock pin disposed within the transverse bore.

In other aspects of the method, the key knob can include a keyed surface engaged with a surface of the die block to prevent inadvertent rotation of the key knob. The method can also include providing a biasing component adjacent the key knob and depressing the key knob against the biasing component to release the keyed surface of the key knob, allowing the key knob to rotate.

Other aspects of methods included in the present technology will be understood by those of ordinary skill in the art.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Furthermore, the described features, structures, or characteristics can be combined in any suitable manner in one or more examples. In the preceding description, numerous specific details were provided, such as examples of various configurations to provide a thorough understanding of examples of the described technology. It will be recognized, however, that the technology can be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements can be devised without departing from the spirit and scope of the described technology.

What is claimed is:

1. A quick release die block system, comprising:

a die block support;

a die block releasably coupled to the die block support; and a lock mechanism operable with the die block support and the die block, the lock mechanism comprising one or more lock pins moveably supported, and adapted to releasably secure the die block to the die block support, the lock mechanism further comprising a lock mechanism interface that is accessible via a passage in the die block.

2. The system of claim 1, wherein the die block support comprises a piston, and wherein the die block is releasably secured to the piston without energizing the piston.

3. The system of claim 1, wherein the die block has a face, wherein the lock mechanism interface is accessible from the face of the die block.

4. The system of claim 1, wherein the lock mechanism comprises a cam pin and the one or more lock pins comprise a cam surface.

5. The system of claim 4, wherein the lock mechanism interface engages with the cam pin of the lock mechanism to rotate the cam pin when the lock mechanism interface is rotated, causing the at one or more lock pins to move between an unlocked and a locked position.

6. The system of claim 5, wherein the die block support comprises a transverse bore and the die block comprises at least one lock notch, wherein the one or more lock pins are disposed within the transverse bore.

7. The system of claim 6, wherein the one or more lock pins is disposed partially within the transverse bore of the die block support and partially within the lock notch of the die block in the locked position.

8. The system of claim 1, wherein the lock mechanism interface comprises a key knob disposed within the passage of the die block, the key knob configured to operate the lock mechanism when actuated by a hand tool.

9. The system of claim 8, further comprising a biasing component adjacent the key knob, wherein the key knob comprises a keyed surface engaged with a mating surface of the die block preventing rotation of the key knob.

10. The system of claim 1, further comprising a retainer plate coupled to the die block support, the retainer plate comprising a slot.

11. The system of claim 10, wherein the lock mechanism comprises a lock pin rotatably supported within the passage of the die block, the lock pin operable between a locked and an unlocked position, wherein the lock pin engages the slot of the retainer plate in the locked position.

12. The system of claim 1, wherein the lock mechanism comprises one or more lock pins biased in one direction via a biasing component.

13. The system of claim 12, wherein the one or more lock pins are biased toward either the locked position or the unlocked position.

14. The system of claim 1, wherein the lock mechanism interface comprises a pressurized fluid intake device.

15. The system of claim 14, further comprising a channel in fluid communication with the pressurized fluid intake device and a transverse bore of the die block support between the one or more lock pins of the lock mechanism and a stationary block.

16. A method for releasably coupling a die block to a support, comprising:

providing a die block support;

providing a die block releasable coupled to the die block support;

providing a lock mechanism operable with the die block support and the die block, the lock mechanism comprising one or more lock pins moveably supported, and adapted to releasably secure the die block to the die block support, the lock mechanism further comprising a lock mechanism interface that is accessible via a passage in the die block;

actuating the lock mechanism interface to engage the one or more lock pins and couple the die block to the die block support; and actuating the lock mechanism interface to disengage the one or more lock pins to release the die block from the die block support.

17. The method of claim 16, wherein the die block support comprises a piston, and wherein the die block is releasably secured to the piston without energizing the piston.

18. The method of claim 16, wherein the die block has a face, wherein the lock mechanism interface is accessible from the face of the die block.

19. The method of claim 16, wherein the die block further comprises a face, a back surface, and at least one side surface, the back surface having an aperture, wherein a portion of the die block support is disposed in the aperture of the die block.

20. The method of claim 16, further comprising providing a retainer plate coupled to the die block support, the retainer plate comprising a slot.

21. The method of claim 20, wherein the lock pin is operable between a locked and an unlocked position with the lock pin engaging the slot of the retainer plate in the locked position.

22. The method of claim 16, wherein the lock mechanism further comprises a cam pin, wherein the one or more lock pins comprise a cam surface.

23. The method of claim 16, wherein the lock mechanism interface engages with the cam pin of the lock mechanism to rotate the cam pin when the lock mechanism interface is rotated, wherein rotation of the cam pin causes the one or more lock pins to move between an unlocked and a locked position.

24. The method of claim 16, wherein the lock mechanism interface comprises a pressurized fluid intake device.

25. A quick release die block system, comprising:

a die block releasably coupled to a die block support, the die block comprising a passage;

a lock mechanism comprising a lock pin rotatably supported within the passage of the die block; and a retainer plate coupled to the die block support, the retainer plate comprising a slot;

wherein the lock pin is operable between a locked and an unlocked position with the lock pin engaging the slot in the locked position.

26. The system of claim 25, wherein the die block support comprises a piston, and wherein the die block is releasably secured to the piston without energizing the piston.

27. The system of claim 25, further comprising a lock pin housing coupled to the die block.

28. The system of claim 27, wherein the lock pin is rotatably supported within the passage of the die block by the lock pin housing.

29. The system of claim 25, wherein the lock mechanism further comprises a lock mechanism interface that is accessible via a passage in the die block.

30. The system of claim 29, wherein the die block has a face, wherein the lock mechanism interface is accessible from the face of the die block.

31. The system of claim 29, wherein the lock mechanism interface comprises a key knob disposed within the passage of the die block, the key knob configured to operate the lock mechanism when actuated by a hand tool.

32. The system of claim 31, further comprising a biasing component adjacent the key knob, wherein the key knob comprises a keyed surface engaged with a mating surface of the die block preventing rotation of the key knob.

33. A quick release die block system for the gripper of a backup wrench, comprising:

a die block support comprising a transverse bore;

a die block releasably coupled to the die block support;

a lock mechanism operable with the die block support, and comprising one or more lock pins moveably supported within the transverse bore of the die block support, and biased in one direction via a biasing component;

a pressurized fluid intake device supported about the die block, and adapted to receive a pressurized fluid; and a channel in fluid communication with the fluid coupler, and in fluid communication with the transverse bore between the one or more lock pins and a stationary block, wherein the pressurized fluid, upon being received through the fluid intake device, is adapted to energize and displace the one or more lock pins to overcome a biasing force provided by the biasing component, and to facilitate releasing of the die block from the die block support.

34. The system of claim 33, wherein the die block support comprises a piston, and wherein the die block is releasably secured to the piston without energizing the piston.

35. The system of claim 33, wherein the die block has a face, and wherein the pressurized fluid intake is accessible from the face of the die block.

* * * * *